US009227750B2

(12) United States Patent
Franic

(10) Patent No.: US 9,227,750 B2
(45) Date of Patent: Jan. 5, 2016

(54) CARTON WITH POUR SPOUT

(75) Inventor: Ivica Franic, Vienna (AT)

(73) Assignee: Elopak Systems AG, Glattbrugg (CH)

( * ) Notice: Subject to any disclaimer, the term of this patent is extended or adjusted under 35 U.S.C. 154(b) by 2114 days.

(21) Appl. No.: 10/547,022

(22) PCT Filed: Feb. 25, 2004

(86) PCT No.: PCT/GB2004/000763
§ 371 (c)(1),
(2), (4) Date: Sep. 28, 2005

(87) PCT Pub. No.: WO2004/076302
PCT Pub. Date: Sep. 10, 2004

(65) Prior Publication Data

US 2006/0144912 A1 Jul. 6, 2006

(30) Foreign Application Priority Data

Feb. 25, 2003 (GB) ..... 0304249.6

(51) Int. Cl.
*B65D 5/74* (2006.01)
*B65D 43/00* (2006.01)
*B65D 5/06* (2006.01)
*B65D 5/02* (2006.01)

(52) U.S. Cl.
CPC ..... *B65D 5/067* (2013.01); *B65D 5/029* (2013.01); *B65D 5/746* (2013.01)

(58) Field of Classification Search
USPC ..... 229/125.15, 125.42, 125.14, 214, 215, 229/248; 222/526, 528, 531, 535
See application file for complete search history.

(56) References Cited

U.S. PATENT DOCUMENTS

| | | | | |
|---|---|---|---|---|
| 5,076,493 | A * | 12/1991 | Anderson | 229/125.15 |
| 5,716,471 | A * | 2/1998 | Pape | 156/69 |
| 5,803,349 | A * | 9/1998 | Ljungstrom | 229/137 |
| 6,253,994 | B1 * | 7/2001 | Mogard | 229/125.14 |
| 2001/0008252 | A1 * | 7/2001 | Ammons et al. | 229/184 |

FOREIGN PATENT DOCUMENTS

WO WO 0123260 A1 * 4/2001 ..... B65D 5/74

OTHER PUBLICATIONS

Definitions of the words "linear" and "line"; from Webster's Third New International Dictionary; 2 pages.
Definition of the word "line"; from dictionary.com.

(Continued)

*Primary Examiner* — Christopher Demeree
(74) *Attorney, Agent, or Firm* — Warn Partners, P.C.

(57) ABSTRACT

A package comprises a top-sealed gable-top carton, a flowable substance contained in the carton, and a pour spout fitment (72) openable to pour the substance from the carton, the carton including a top closure including a front roof sub-panel (130) carrying and sealed to the fitment (72), the carton also including a front body sub-panel (140), the boundary zone between the roof sub-panel (130) and the front sub-panel (140) comprising an edge protruding into the front sub-panel 140, and the fitment (72) extending to adjacent to that edge. It is thereby possible to provide on a gable-top carton a pour spout fitment having a greater through-flow cross-sectional area than would be the case if the above-mentioned boundary zone were not to protrude into the front sub-panel.

41 Claims, 20 Drawing Sheets

(56) References Cited

OTHER PUBLICATIONS

Figure 1:
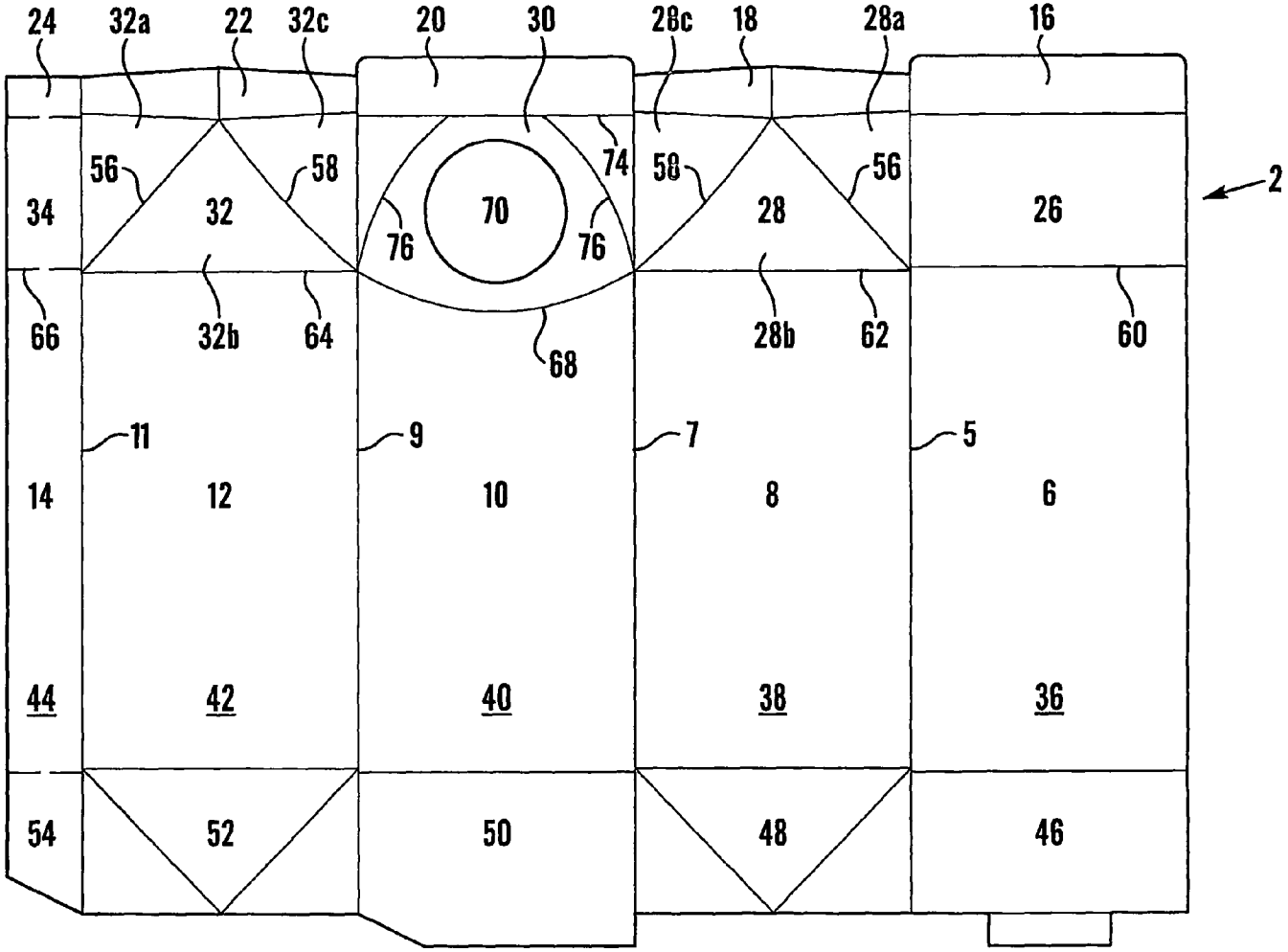

Definition of the word "adjacent"; from Webster's Third New Internaional Dictionary; 1 page.

Definition of the word "gable-top box"; from the United States Patent and Trademark Office's Classification index.

* cited by examiner

CARTON WITH POUR SPOUT

This invention relates to carton blanks and packages incorporating cartons made from the blanks.

WO 95/30584 discloses a gable-top carton and its corresponding blank, the carton including curved side creases that are defined by curved score lines that divide one or more side panels from the top gabled structure and/or a bottom structure. The purpose of the curved score lines that divide the or each side panel from the top gabled structure is to enlarge the effective opening area by providing more room for a user's thumbs when prying open the gabled structure.

WO 01/23260 discloses a re-sealable container comprising a rectangular bottom surface, four body surfaces, which are essentially located at right angles to each other, a top area which is sealed with a segmented seam after the container has been filled, and a pour spout fitment which is located on a sloped surface in the top area. The container is folded in such a way that the sloped surface supporting the fitment extends at least partially out of the rectangular profile defined by the bottom surface, so that the body surface located beneath the sloped surface bulges out and the body surface opposite the protruding body surface has a corresponding indentation, at least in the top area.

EP-A-1172301 discloses a flat-top sealed package for pourable food products, made from sheet packaging material and having a top wall crossed by a transverse sealing band forming a flat projecting tab folded co-planarly with and onto the top wall along a bend line and a pour spout fitment fitted to a portion of the top wall bounded on one side by the sealing band; the tab has a flat strip-like auxiliary portion interposed between the sealing band and the bend line, so that the area of the portion of the top wall available for the fitment is increased by the width of the auxiliary portion. One embodiment described has its front, rear and side walls connected to one another by bevelled intermediate portions and its top wall oblique with respect to the horizontal and forming with the front wall a convex C-shaped or "smile crease" front edge projecting outwardly.

In an anonymous Research Disclosure entitled "Portion Package for Pourable Food Products" [Kenneth Mason Publications, Hampshire, United Kingdom, vol. 414, no. 41, October 1998 (1998-10), XP007123399; ISSN:0374-4353] a package is disclosed which is provided with a curved crease line in the packaging material at the uppermost edge of the front panel of the package, such that a larger top panel is provided. Additionally, by folding the fin of the uppermost transverse seal of the package in a direction extending away from the curved crease line, the available space on the top panel is even further increased. The arrangement permits a larger drinking opening and a larger opening device to be used on such a package.

According to a first aspect of the present invention, there is provided a carton blank for a gable-top carton and comprising a row of panels arranged side-by-side, the boundaries among said panels being defined by a set of lines of weakness parallel to each other, one of said panels including not only a first region for forming a first top obturating sub-panel comprising a plurality of substantially triangular sub-sub-panels defined by lines of weakness, but also, disposed outwardly thereof, a first top sealing sub-panel, another of said panels immediately adjacent said one of said panels including not only a second region for forming a quadrangular top obturating sub-panel, but also disposed outwardly thereof, a second top sealing sub-panel, and, inwardly thereof, a body sub-panel, said second region including a boundary zone furthest from its boundary with said second top sealing sub-panel, said boundary zone having a linear weakness which is discontinuous and/or comprises linear weakness portions which extend transversely of said row of panels.

According to a second aspect of the present invention, there is provided a package comprising a top-sealed gable-top carton, a flowable substance contained in said carton, and a pour spout fitment openable to pour said substance from said carton, said carton including a top closure including a roof sub-panel carrying and sealed to said fitment, said carton also including a front sub-panel extending downwardly from a boundary zone between said roof sub-panel and said front sub-panel, said boundary zone being constituted by an edge protruding into said front sub-panel, and said fitment extending to adjacent to said edge.

Owing to these two aspects of the invention, it is possible to provide on a gable-top carton a pour spout fitment having a greater through-flow cross-sectional area than would be the case if the above-mentioned boundary zone were not to protrude into the front sub-panel.

According to a third aspect of the present invention, there is provided a carton blank of laminate packaging material and including a row of panels arranged side-by-side, the boundaries among said panels being defined by a set of lines of weakness parallel to each other, one of said panels having a region for forming a quadrangular top obturating sub-panel, another region for forming a body sub-panel, and linear weakness portions between those regions and extending inwardly from respective opposite upper edge zones of said other regions, such that, progressing inwardly from said respective opposite upper edge zones, the distance between each of said linear weakness portions and a central zone of the first-mentioned region initially decreases and then increases.

According to a fourth aspect of the present invention, there is provided a package comprising a top-sealed carton of laminate packaging material, and a flowable substance contained in said carton, said carton including a top closure including a quadrangular roof sub-panel, and a body sub-panel extending downwardly from a boundary between said roof sub-panel and said body sub-panel, said boundary comprising linear weakness portions which extend inwardly from respective opposite upper edge zones of said body sub-panel, such that, progressing inwardly from said respective opposite upper end zones, the distance between each of said linear weakness portions and a central zone of said roof sub-panel initially decreases and then increases.

According to a fifth aspect of the present invention, there is provided a carton blank of laminate packaging material and including a row of panels arranged side-by-side, the boundaries among said panels being defined by a set of lines of weakness parallel to each other, one of said panels including a region for forming a quadrangular top obturating sub-panel, another region for forming a body sub-panel, and a discontinuous linear weakness therebetween.

According to a sixth aspect of the present invention, there is provided a package comprising a top-sealed carton of laminate packaging material, and a flowable substance contained in said carton, said carton including a top closure including a quadrangular roof sub-panel, and a body sub-panel extending downwardly from a boundary between said roof sub-panel and said body sub-panel, said boundary including a discontinuous linear weakness.

According to a seventh aspect of the present invention, there is provided a package comprising a top-sealed carton of laminate packaging material, a flowable substance contained in said carton, and a pour spout fitment openable to pour said substance from said carton, said carton including a top closure including a quadrangular roof sub-panel carrying and sealed to said fitment, said carton also including a front sub-panel extending downwardly from a boundary between said roof sub-panel and said front sub-panel, said boundary being constituted by an edge having no pre-formed linear weakness portion immediately adjacent to a lowest and foremost portion of said fitment.

Owing to these aspects of the invention, it is possible to obtain a carton on which the boundary between a body sub-panel and its adjacent quadrangular roof sub-panel is not a continuous pre-formed rectilinear weakness and which has been automatically formed from a blank with less risk of breaking or cracking of the laminate packaging material from which the carton has been made.

The invention is applicable particularly, but not necessarily, to a gable-topped carton; it is also applicable to a slant-topped carton. Advantageously, the carton includes a pour spout fitment located on a top obturating roof sub-panel and which is preferably in the form of a screw cap or a hatch. The fitment preferably has a flange which is sealed to either the inside surface or the outside surface of the top obturating sub-panel which is to be the roof panel in question; in the former case the fitment will be inserted from the inside of the carton into a hole in the roof panel.

In a carton, particularly one of a relatively small internal volume, having its top closure sub-panels consisting of an outermost row of sealing sub-panels to be sealed together to form a sealing fin, and an inner row of obturating sub-panels to provide two opposite, quadrangular, roof sub-panels, and, at each end of the roof, three triangular folded-in sub-sub-panels, it is possible to allow for the presence of a flange of a pour spout fitment having a relatively large through-flow cross-sectional area which has been mounted through a hole through one of the roof sub-panels, which flange is sealed to the inside surface of the roof sub-panel in question, by providing a pair of slightly curved edges, one at each end of the roof, between the triangular sub-sub-panel immediately under the roof sub-panel carrying the fitment and the triangular sub-sub-panel extending along the top edge of the adjacent lateral sub-panel.

Further lines of weakness can be added to the top obturating roof sub-panel depending upon the structure of the packaging laminate used to make the carton and upon the presence of a pour spout fitment and the type of flange provided on the fitment. If the material used is a relatively stiff polymer-coated paperboard and a pour spout fitment is present having, for example, a relatively pliable flange, a pair of weaknesses in the roof sub-panel to respective opposite lateral sides of the fitment can be provided to promote correct folding of the blank to form the carton.

When the a package comprises a gable-top carton, with a pour spout fitment openable to pour the substance from the carton, the boundary zone between the rear roof sub-panel and the rear sub-panel is preferably constituted by an edge protruding into the rear body sub-panel to a level below the lowest and foremost portion of the fitment. Thereby, arranging of a plurality of the cartons in a single layer and in a front-surface-to-back-surface manner for storage and/or transportation can be carried out without the fitment on a rearward carton being jammed against the upper boundary zone of the rear body sub-panel of a forward carton and thus without thereby creasing or cracking the carton material at the boundary, as would be the case if the boundary were not to protrude into the rear body sub-panel.

Figure 5:
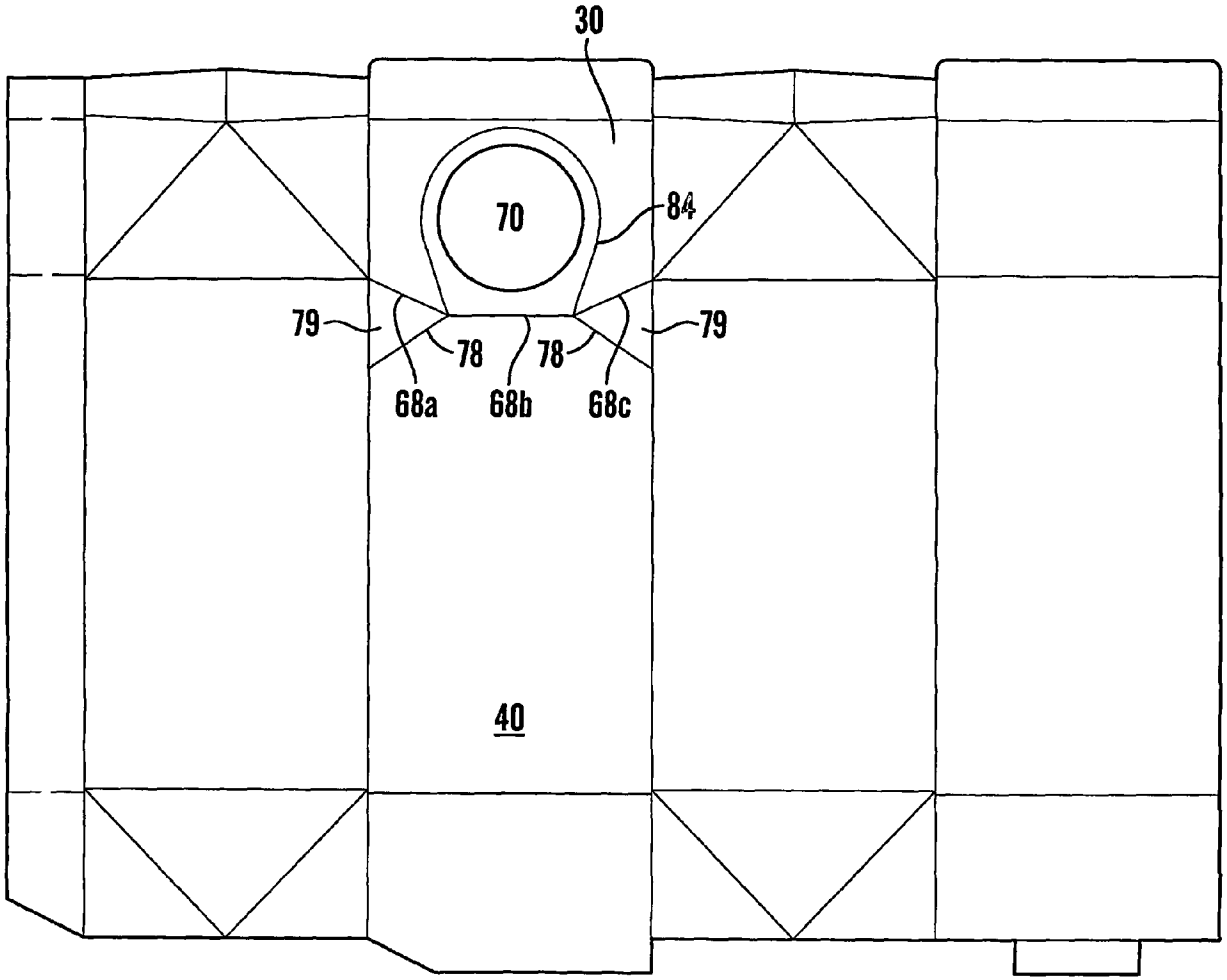
Figure 6:
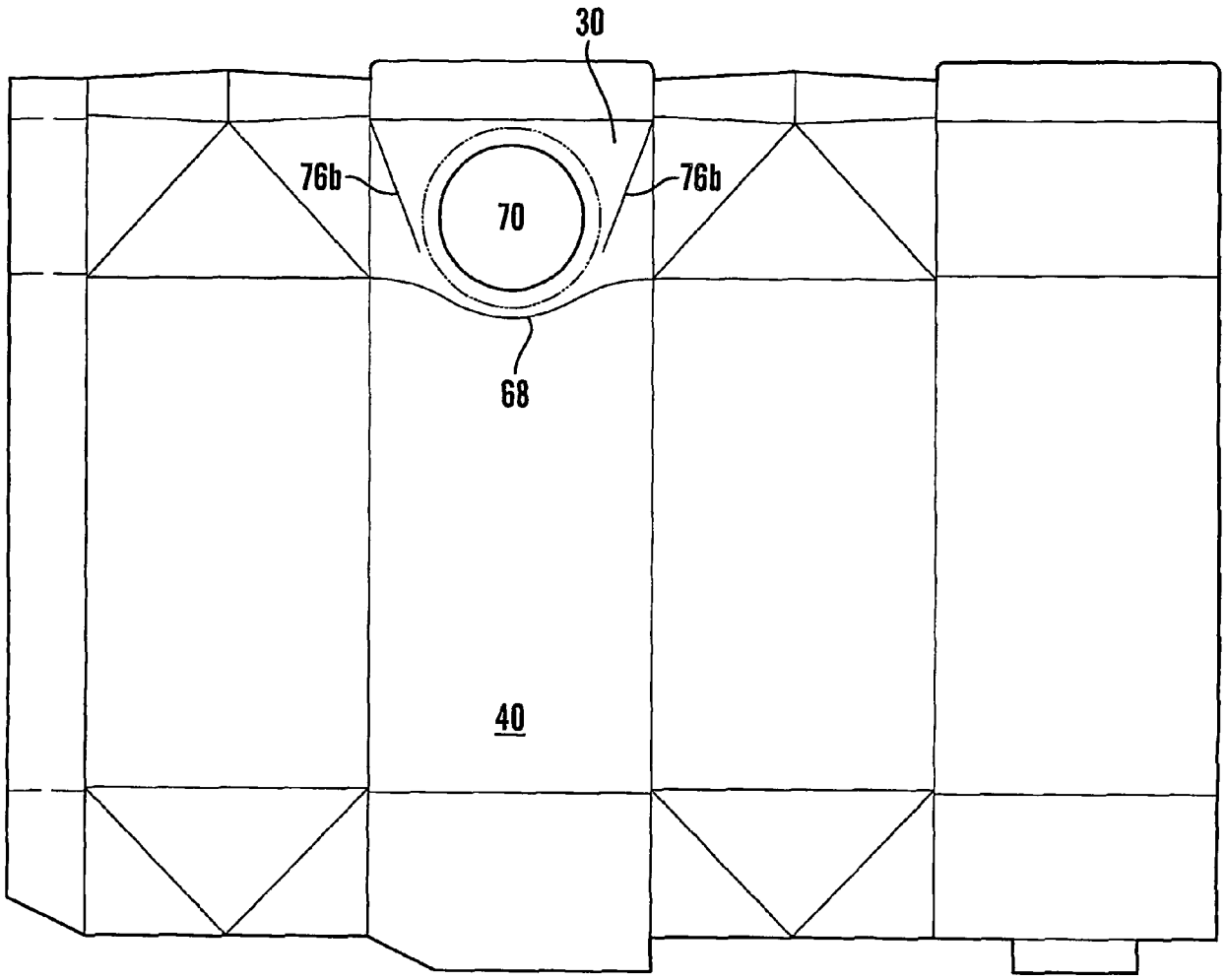
Figure 7:
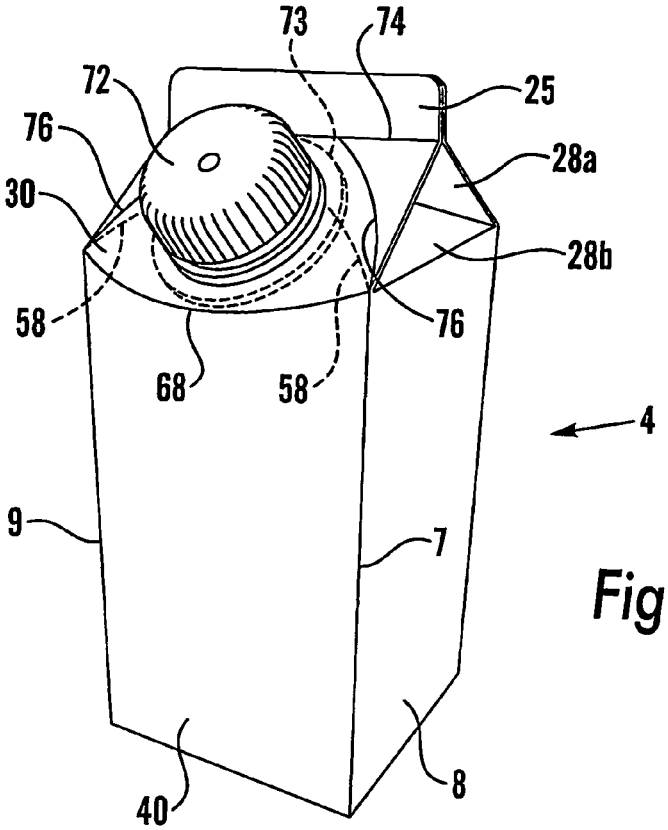
Figure 8:
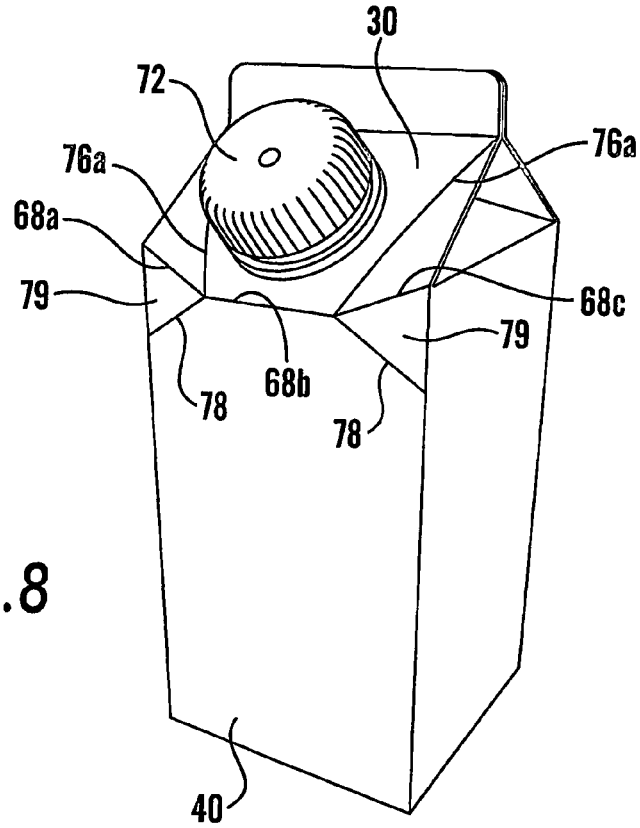
Figure 10:
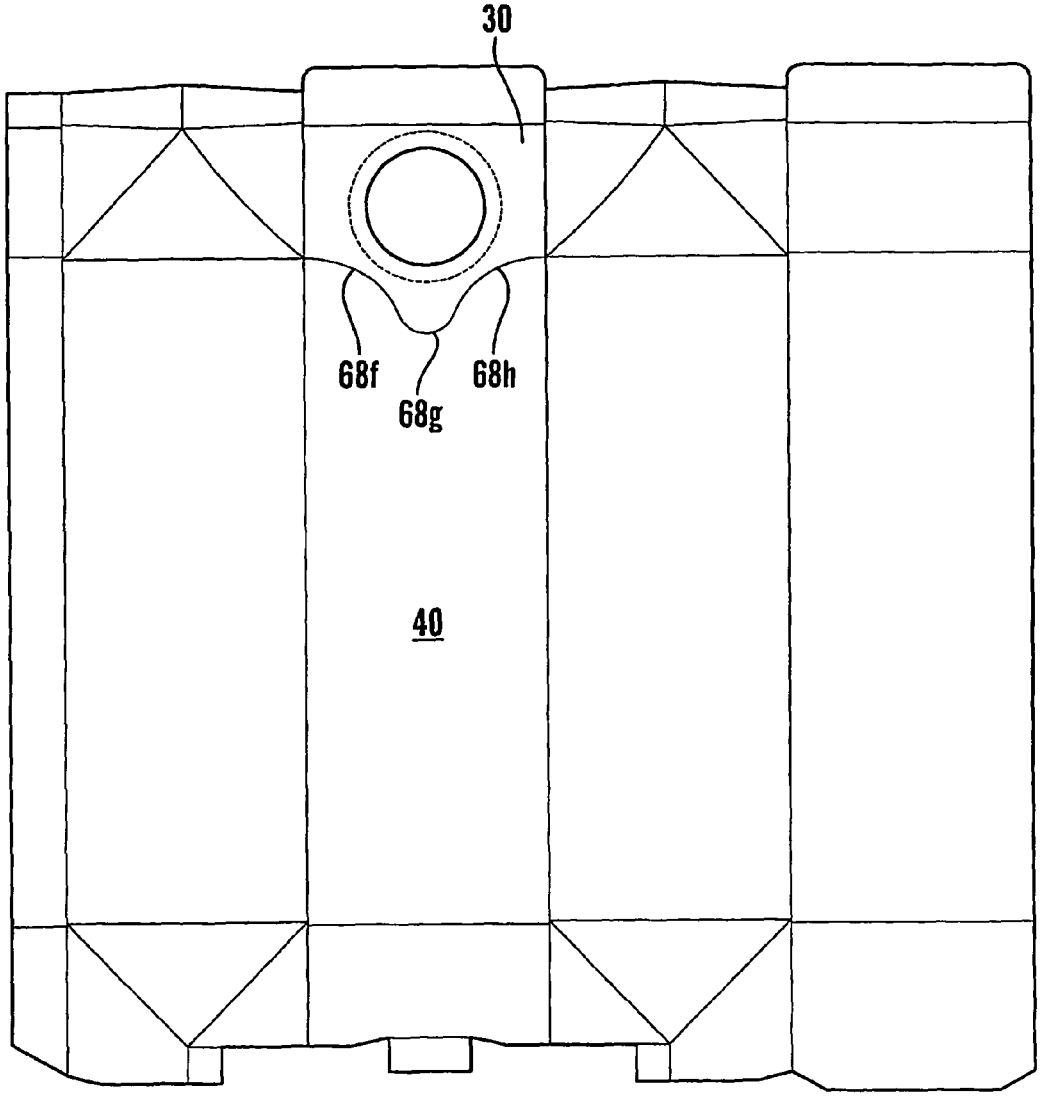
Figure 11:
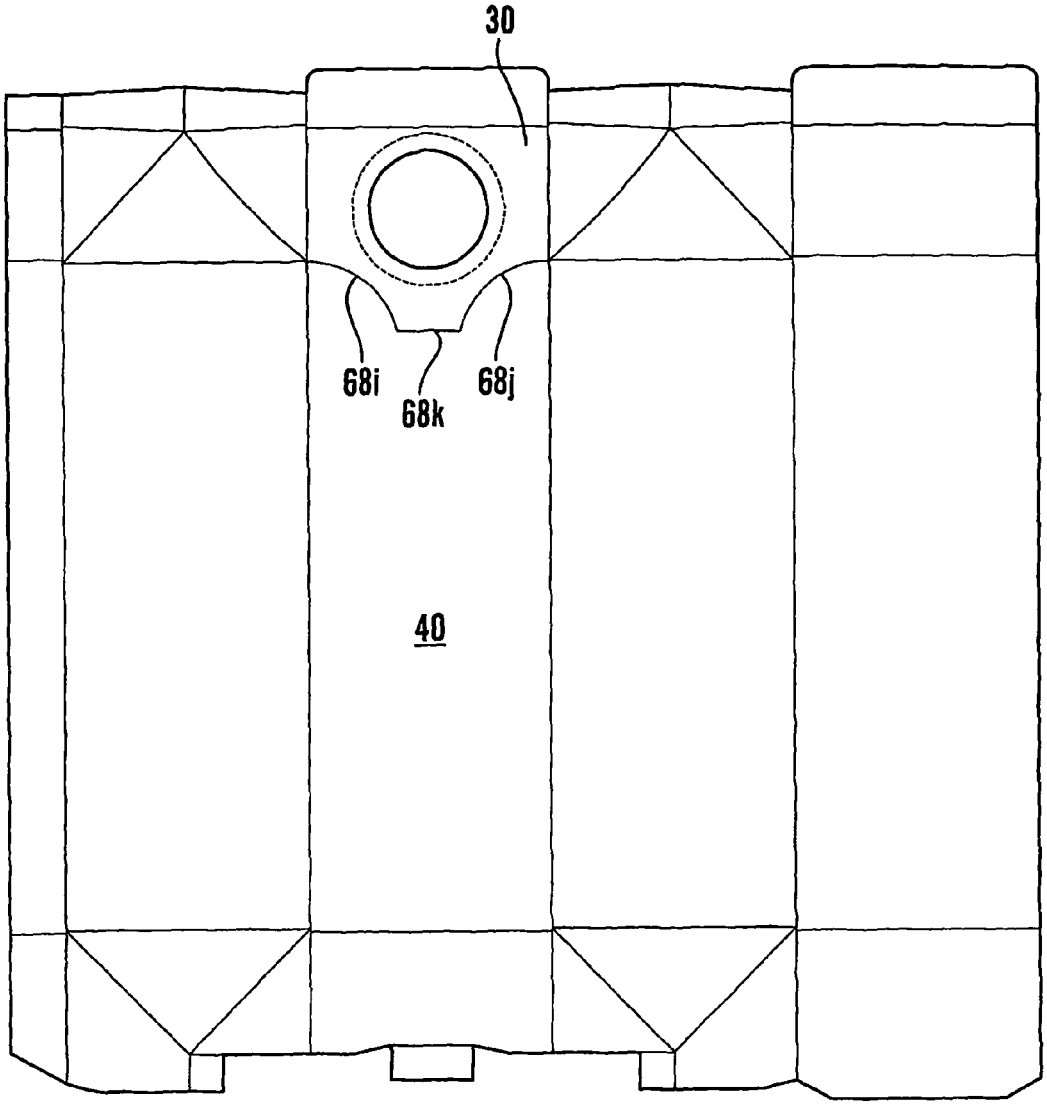
Figure 12:
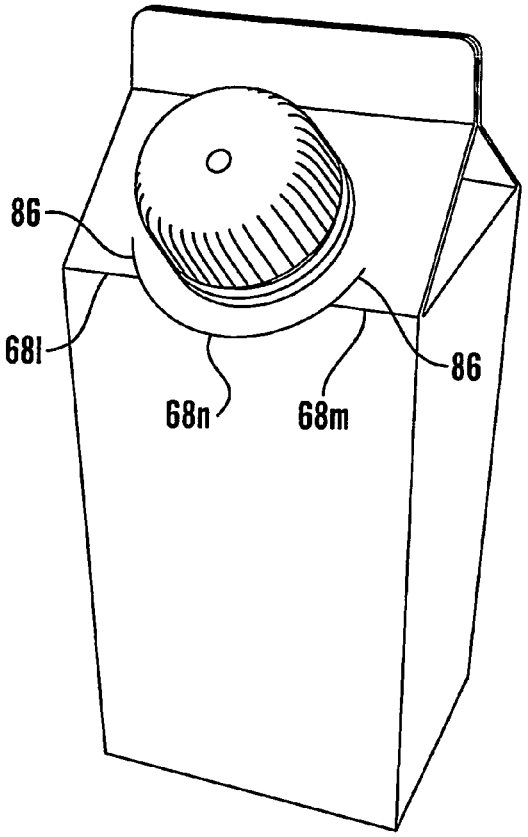
Figure 13:
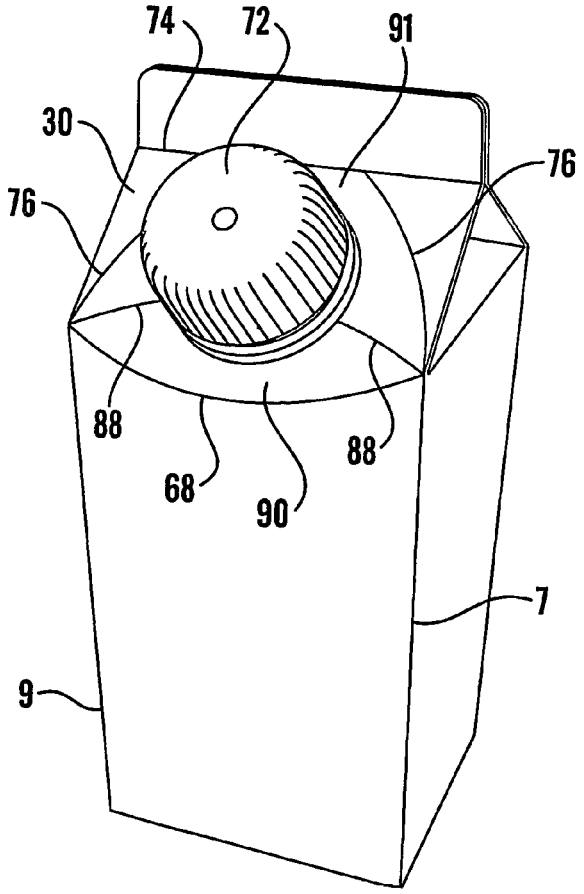
Figure 14:
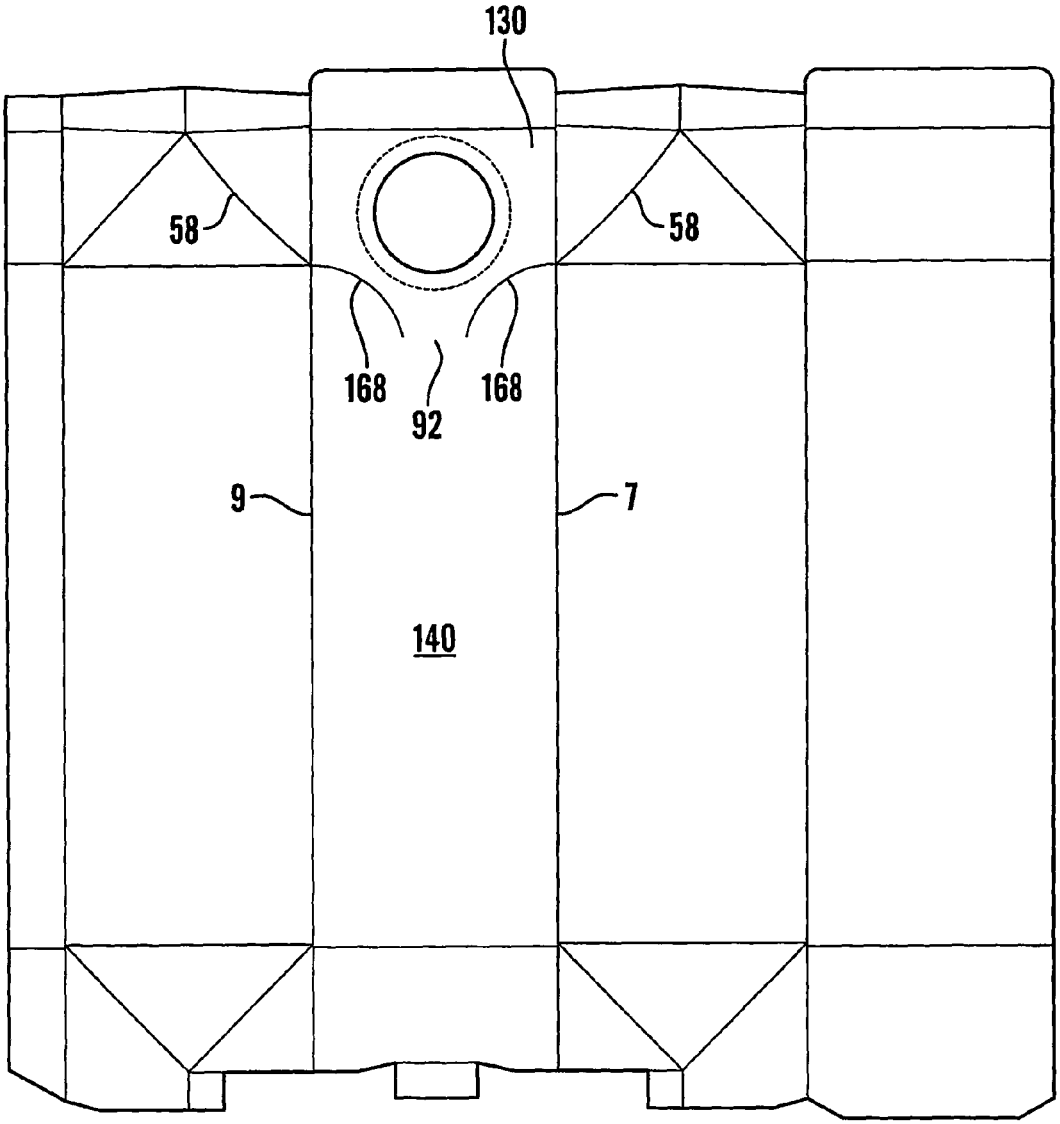
Figure 15:
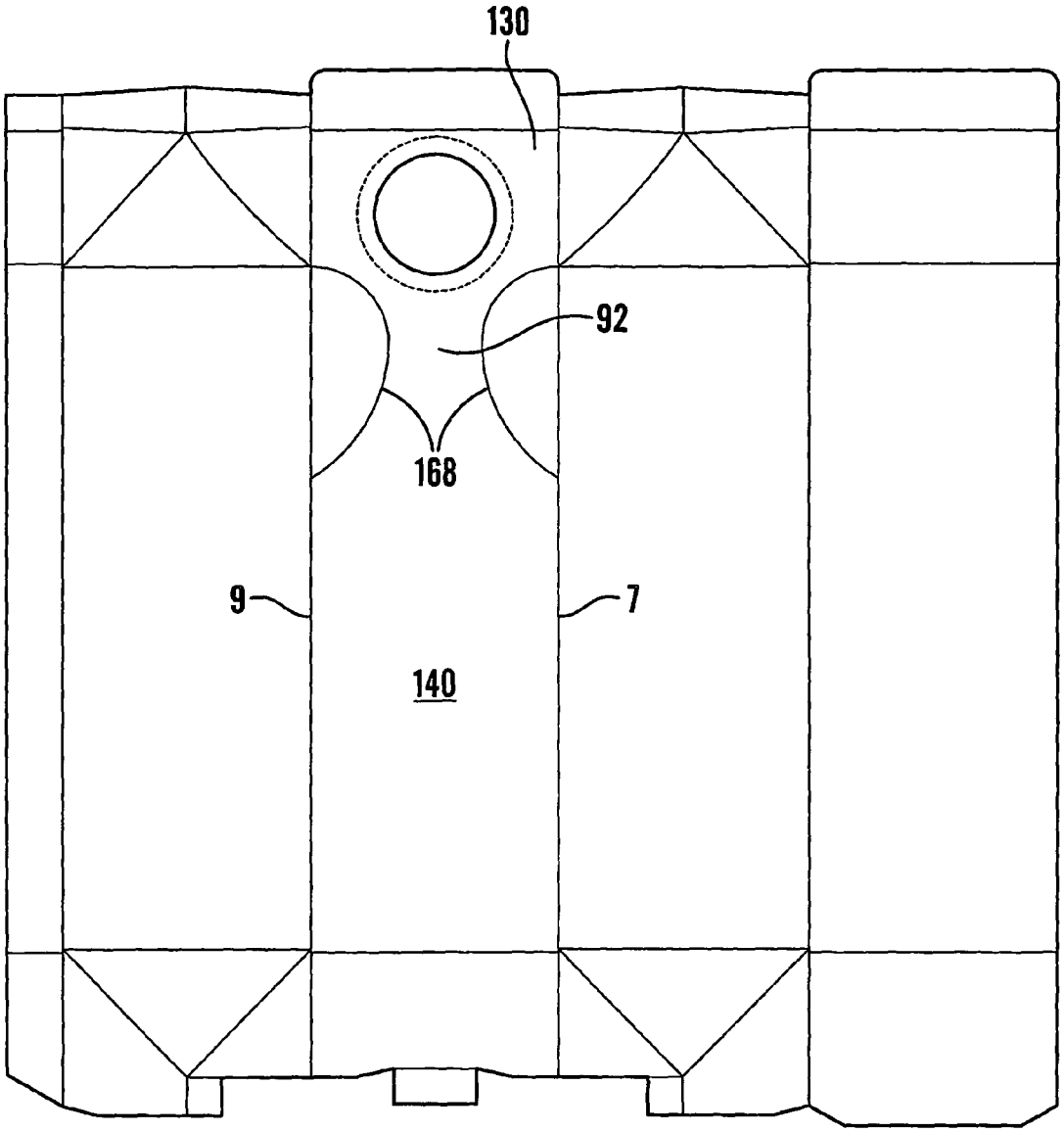
Figure 16:
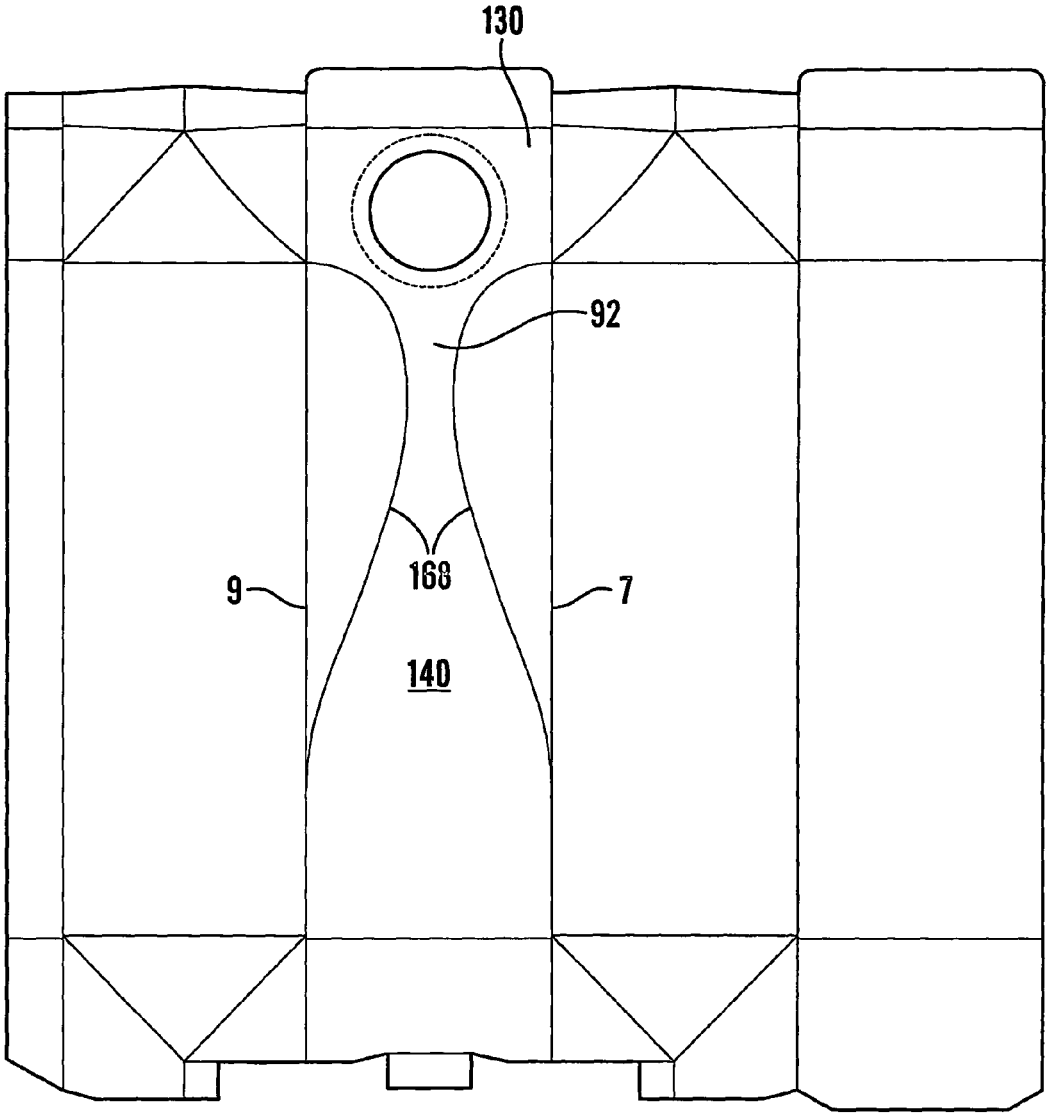
Figure 17:
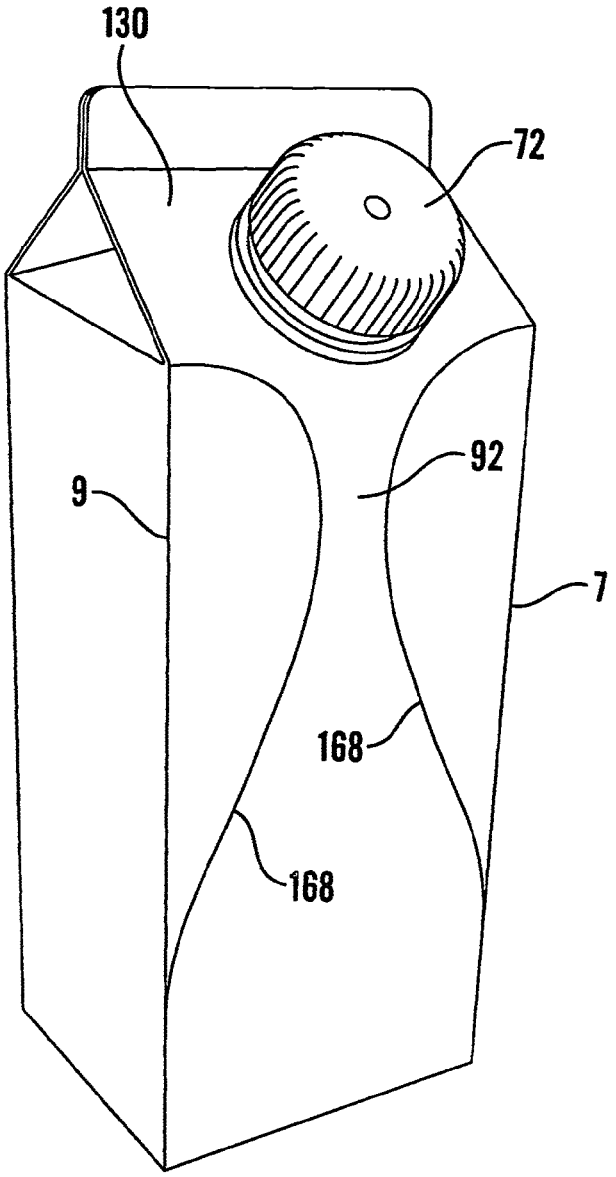
Figure 18:
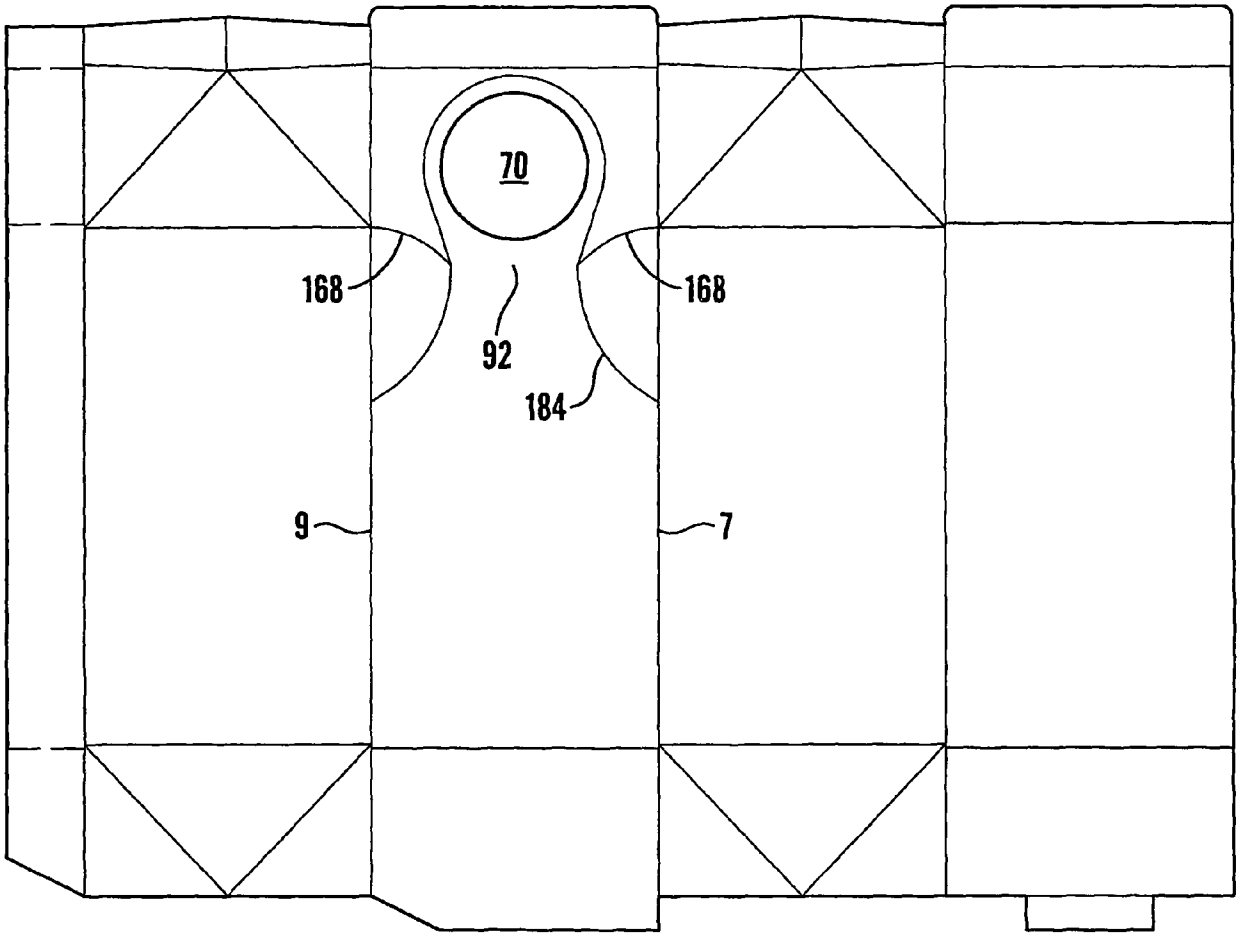
Figure 19:
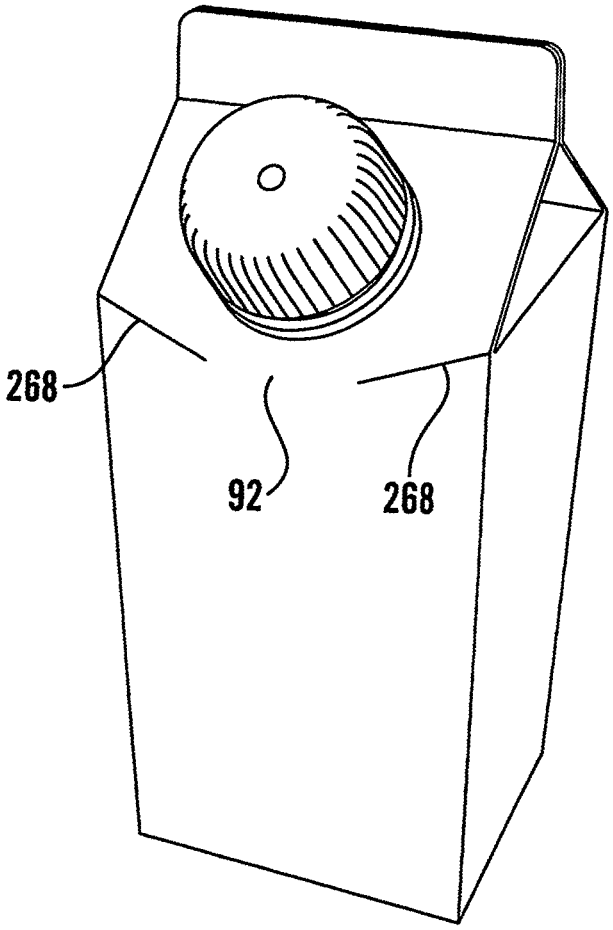
Figure 20:
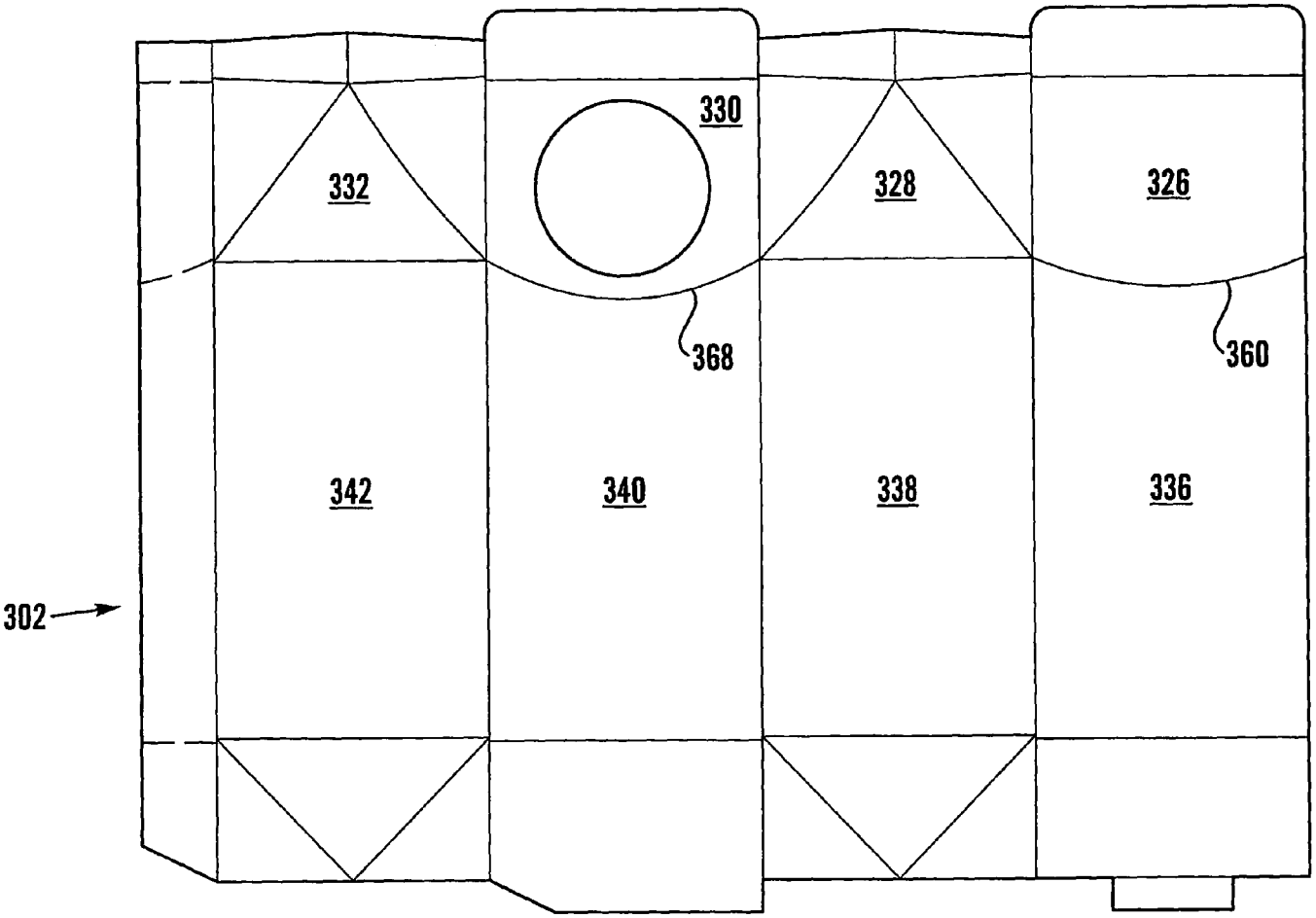
Figure 21:
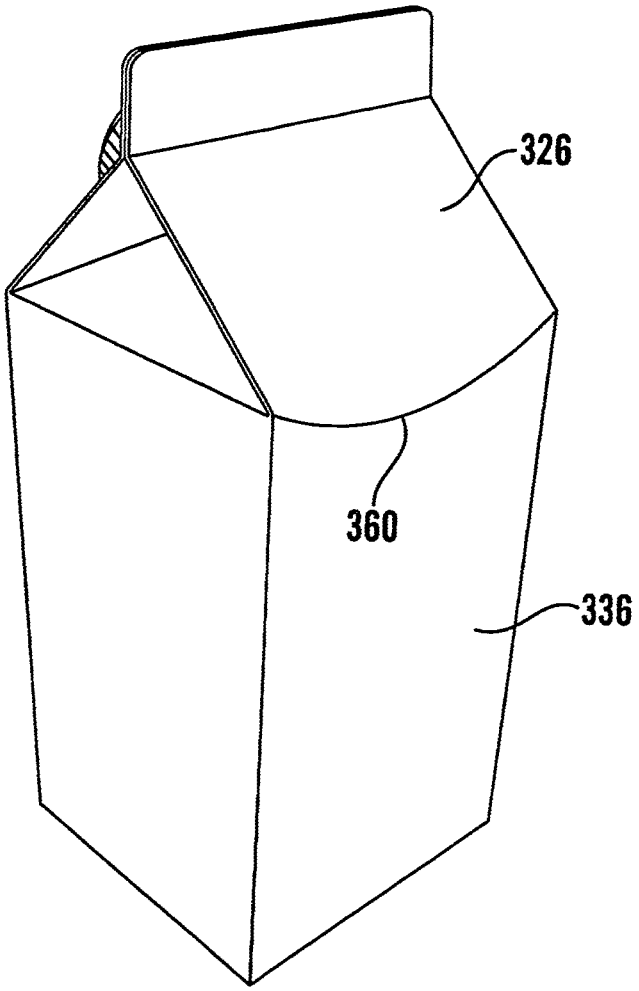
Figure 22:
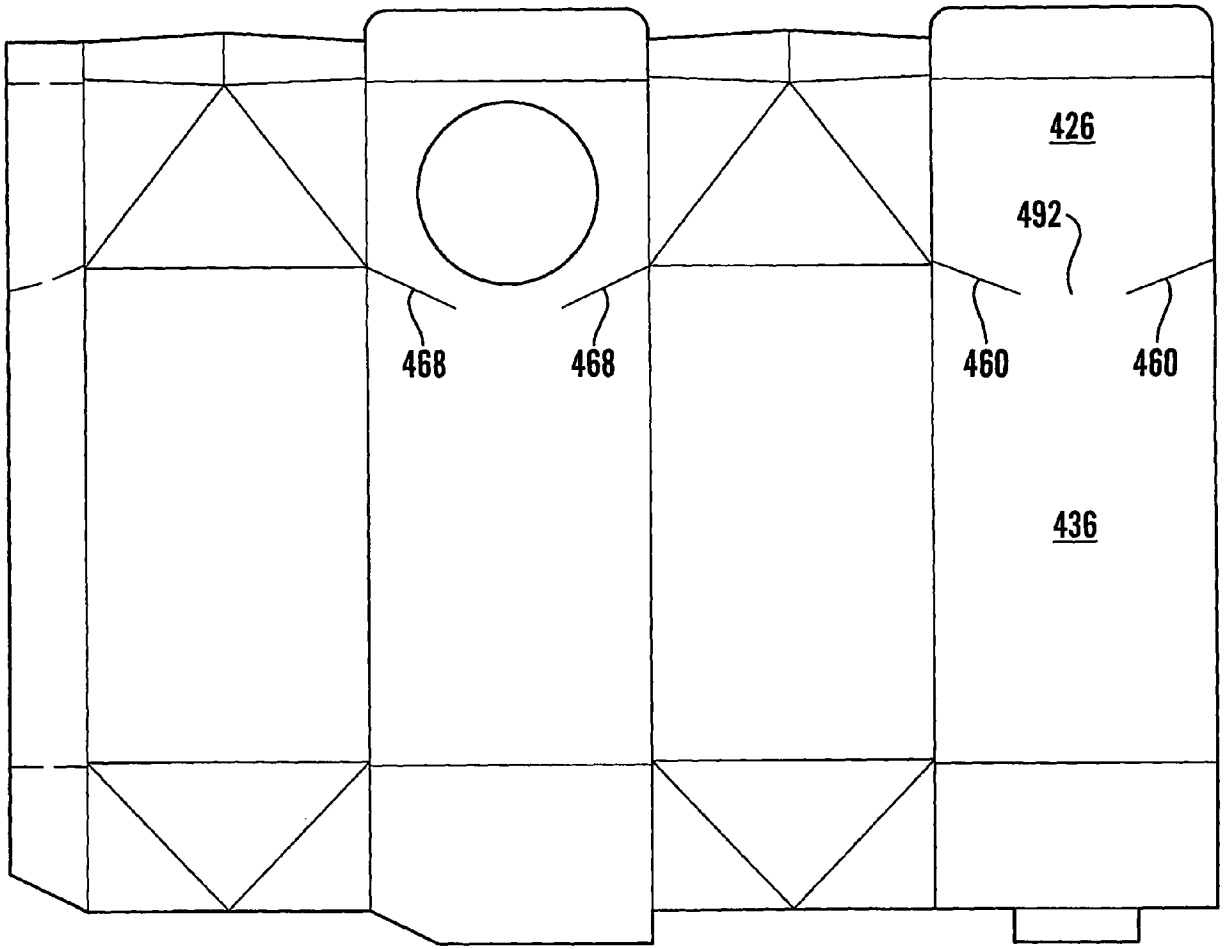

In order that the invention may be clearly and completely disclosed, reference will now be made, by way of example, to the accompanying drawings, in which:

FIGS. 1 to 6 show respective versions of a carton blank to be formed into a carton of a package, FIG. 7 shows a perspective view from the front and above of a package including a carton formed from the carton blank shown in FIG. 1, FIG. 8 is a view similar to FIG. 7, but of a package including a carton formed from the carton blank shown in FIG. 2, FIGS. 9 to 11 show respective other versions of a carton blank to be formed into a carton of a package, FIGS. 12 and 13 are perspective views from the front and above of respective other versions of a package including a carton, FIGS. 14 to 16 show respective further versions of a carton blank to be formed into a carton of a package, FIG. 17 shows a perspective view from the front and above of a package including a carton formed from the carton blank shown in FIG. 16, FIG. 18 shows yet another version of a carton blank to be formed into a carton of a package, FIG. 19 shows a perspective view from the front and above of yet another version of a package including a carton, FIG. 20 shows a further version of a carton blank to be formed into a carton of a package, FIG. 21 shows a perspective view from the rear and above of a package including a carton formed from the carton blank shown in FIG. 20, and FIG. 22 shows a yet still further version of a carton blank to be formed into a carton of a package.

Referring to FIGS. 1 and 7, the carton blank 2 shown in FIG. 1 consists of a laminate consisting of at least a paperboard substrate layer and innermost and outermost layers of thermoplastics and the gable-topped carton 4 formed therefrom is used for packaging liquids, for example milk or fruit juice. The blank 2 consists of four main panels 6, 8, 10 and 12 with a fifth, sealing panel 14, bounded by lines of weakness in the form of score lines 5, 7, 9 and 11 there among. The row of panels 6 to 14 is divided by further lines of weakness in the form of score lines into four rows of sub-panels, namely a row of top sealing sub-panels 16 to 24 to form a sealing fin 25 of the carton 4, a row of top obturating sub-panels 26 to 34, a row of body sub-panels 36 to 44, and a row of bottom closure sub-panels 46 to 54.

The sub-panels 26 and 30 are quadrangular and form respective, quadrangular, roof panels of the gable-topped carton 4, whilst the sub-panels 28 and 32 are quadrangular and each divided by respective straight score lines 56 and respective, slightly curved, score lines 58 into three triangular sub-sub-panels 28*a* to 28*c* and 32*a* to 32*c*. The score lines 58 are bowed away from the sub-panels 20 and 30. The boundaries between the sub-panels 26 and 36; the sub-panels 28 and 38; the sub-panels 32 and 42; and the sub-panels 34 and 44 are defined by respective straight score lines 60, 62, 64 and 66, whilst the boundary between the sub-panels 30 and 40 is defined by a curved score line 68 which, as seen in FIG. 1, protrudes into the sub-panel 40. Formed through the sub-panel 30 is a circular hole 70 for receiving a pour spout fitment 72 of thermoplastics. The boundary between the sub-panels 20 and 30 is defined by a straight score line 74. To respective opposite sides of the hole 70 and bowed away therefrom are curved score lines 76 which extend from respective locations where the score lines 58 and 68 meet the score lines 7 and 9 to respective locations on the score line 74 equidistantly spaced from the respective ends of the score line 74.

The method of production of the package shown in FIG. 7 is as follows. After the blank of FIG. 1 has been produced, the fifth panel 14 is sealed to the opposite panel 6 to form a sleeve open at both ends. This sleeve is subsequently bottom-sealed, by folding inwards of the sub-panels 46 to 54 and sealing of the same, to produce an open-topped, bottom-sealed carton. Then the fitment 72 is lowered into the open top of the carton and is introduced into the hole 70 from inside the carton until a flange 73 thereof abuts the inside surface of the sub-panel 30 round the hole 70, whereupon the thermoplastics flange 73 is sealed to the innermost thermoplastics layer of the sub-panel 30 around the hole 70. Then, the score lines bounding the sub-panels 16 to 34 may be pre-broken. The still open-topped carton is filled with the liquid to be packaged. Then the sub-panels 16 to 34 are folded-in and the sub-panels 16 to 24 sealed to each other to provide a sealed top closure of the carton. During any pre-breaking and during the folding inwards of the sub-panel 30, the proximity of the sealed flange 73 of the fitment 72 to the middle of the downwardly curved score line 68 promotes breaking of the panel 10 at the line of weakness formed by the score line 68 rather than elsewhere, particularly rather than along a line substantially co-linear with the score lines 62 and 64. The score line 68 protrudes only shallowly into the sub-panel 40, since, if it were to protrude deeply, correct breaking thereat would be difficult to achieve. The protrusion of the score line 68 into the sub-panel 40 means that the roof sub-panel 30 at its middle is of a larger dimension that it would be if the score line 68 were to be substantially co-linear with the score lines 62 and 64, so that the panel 30 can therefore accommodate a pour spout fitment 72 of larger external and internal diameters than would otherwise be the case. It also means that the sub-panel 40 in the top-sealed carton 4 bows outwards slightly, particularly at its upper end zone. It further means that the fitment 72 is set slightly more deeply relative to the sub-panels 38 to 42 than would otherwise be the case. To allow for this, the score lines 58 are slightly bowed away from the sub-panels 20 and 30, so that, in the top-sealed condition of the carton, instead of the sub-sub-panels 28*c* and 32*c* lying substantially flatly face-to-face with the underside of the panel 30, which is concave, each is slightly bowed away from that underside leaving a gap therebetween, so that the flange 73 is housed more easily where it projects between the sub-panel 30 and each of the sub-sub-panels 28*c* and 32*c*. This is particularly important where the carton is of a relatively small internal volume and the fitment 72 has a relatively large through-flow cross-sectional area compared to that internal volume. The score lines 76 also assist in allowing for the deeper positioning of the fitment 72, since they promote greater flexibility of the middle part of the sub-panel 30 relative to the lateral parts thereof and thus facilitate folding of the blank 2.

Figure 2:
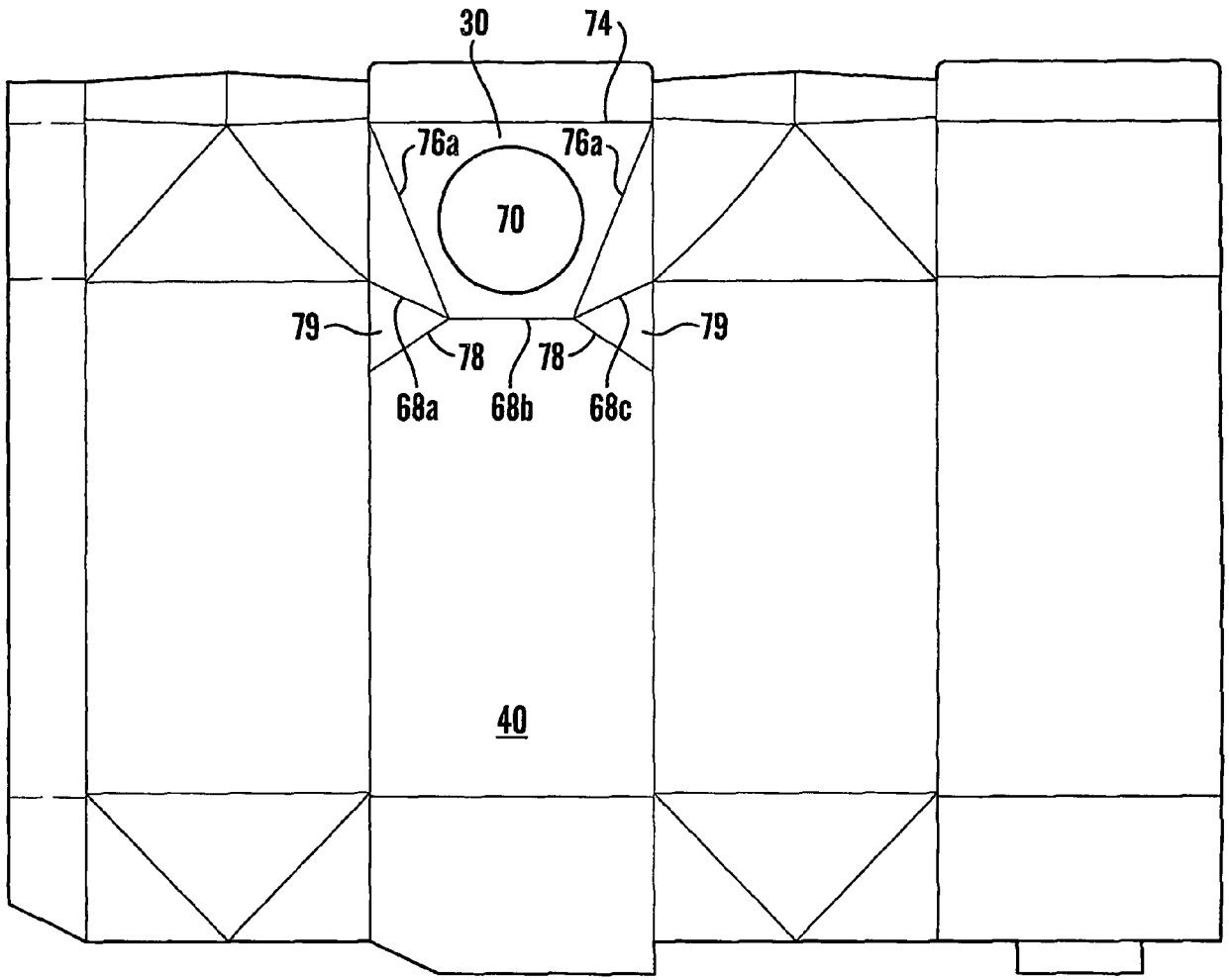

The version of FIG. 2 differs from that of FIG. 1 in that, instead of the line of weakness which forms the boundary between the sub-panels 30 and 40 and protrudes into the sub-panel 40 being in the form of a curved score line 68, it is constituted by three straight score lines 68*a* to 68*c*, whilst the respective lines of weakness in the form of the curved score lines 76 in FIG. 1 are replaced by respective straight score lines 76*a* which extend from the respective junctions among the score lines 68*a* to 68*c* to the respective ends of the score line 74. Also extending downwardly and outwardly from the respective junctions among the score lines 68*a* to 68*c* and to the respective adjacent edges of the sub-panel 40 are short score lines 78, which thereby bound respective sub-sub-panels 79 of the sub-panel 40. The package of FIG. 8 is substantially the same as that of FIG. 7, the score lines 76*a* performing the same function as the score lines 76 in FIG. 7 and the score lines 68*a* to 68*c* performing the same function as the score line 68 in FIG. 7, with the sub-sub-panels 79 helping to control bowing-outwards of particularly the upper end zone of the sub-panel 40.

Figure 3:
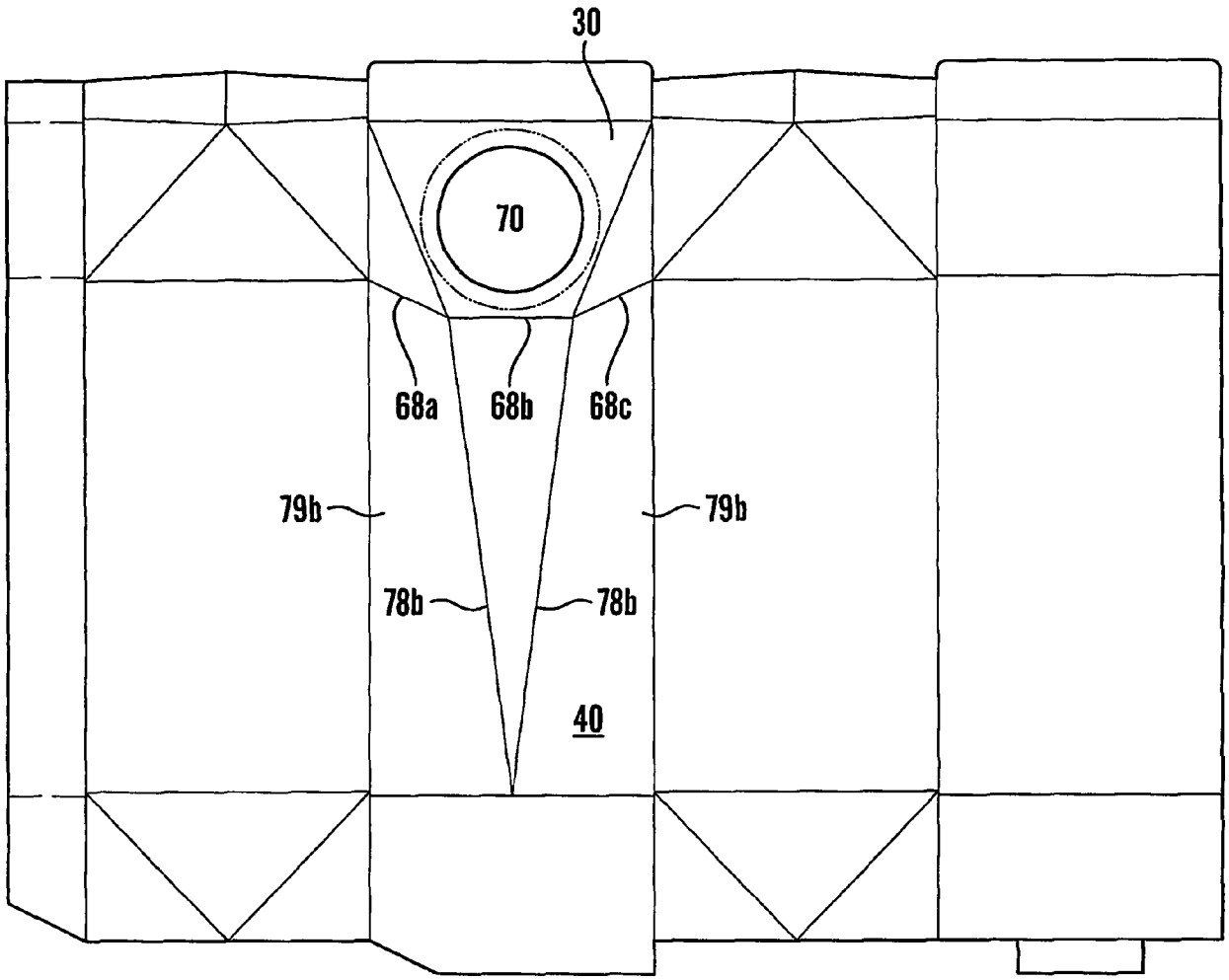

Instead of the lines of weakness constituted by the score lines 78 diverging downwardly as shown in FIG. 2, they may converge downwardly so as possibly to meet each other, possibly at the lowermost edge of the sub-panel 40, as shown in FIG. 3, thereby providing in the latter sub-panel sub-sub-panels 79*b* the function of which again corresponds to that of the sub-sub-panels 79.

Figure 4:
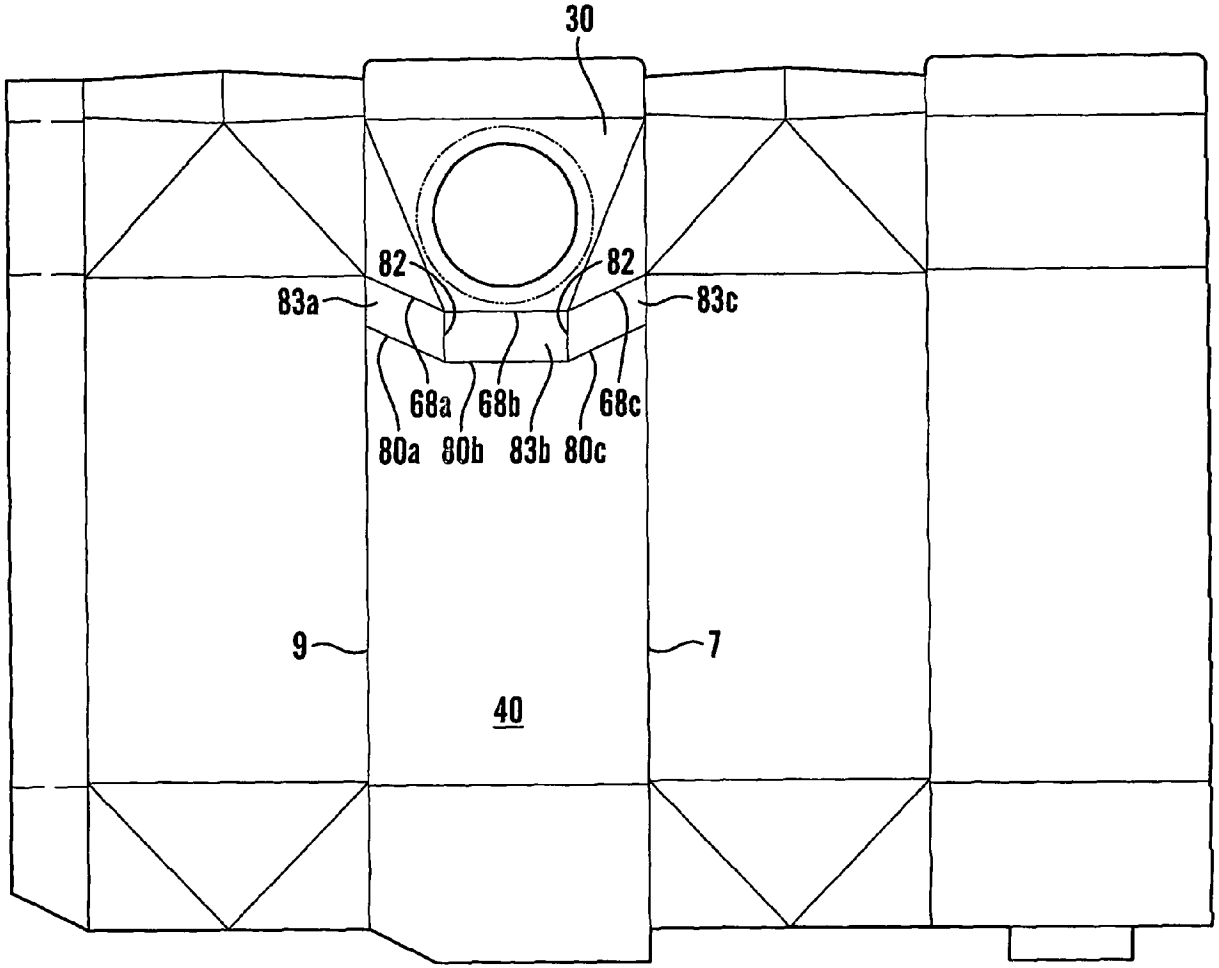

If desired, a further line of weakness may extend across the sub-panel 40 from one to the other of the score lines 7 and 9, substantially parallelly to the line of weakness 68 or 68*a* to 68*c* (for example as shown in FIG. 4, where this further line of weakness is formed by score lines 80*a* to 80*c* parallel to the respective score lines 68*a* to 68*c*), with or without lines of weakness (such as the lines of weakness 82 seen in FIG. 4) extending downwardly from the line of weakness 68 or 68*a* to 68*c*. Thereby, the sub-panel 40 is formed with one sub-sub-panel, or a series of sub-sub-panels (such as the sub-sub-panels 83*a* to 83*c* seen in FIG. 4) spanning the width of the sub-panel 40. The function of this one sub-sub-panel or this series of sub-sub-panels is to facilitate bowing-out of particularly the upper end zone of the sub-panel 40.

The version shown in FIG. 5 differs from that shown in FIG. 2 in that, instead of the lines of weakness constituted by the score lines 76*a*, but performing the same function, there is a loop of weakness constituted by a score line 84 which loops around the hole 70 and terminates at the respective junctions among the score lines 68*a* to 68*c*.

The line of weakness constituted by the score line 68 or the score lines 68*a* to 68*c* need not protrude into the sub-panel 40 over the whole of the width of the sub-panel 40 but may protrude thereinto over only a portion of that width, although preferably a large portion, such as shown in FIG. 6. Furthermore, if desired, as illustrated by the score lines 76*b* in FIG. 6, the lines of weakness constituted by the score lines 76 or 76*a* may terminate short of the line of weakness constituted by the score line 68 or the score lines 68*a* to 68*c*.

Figure 9:
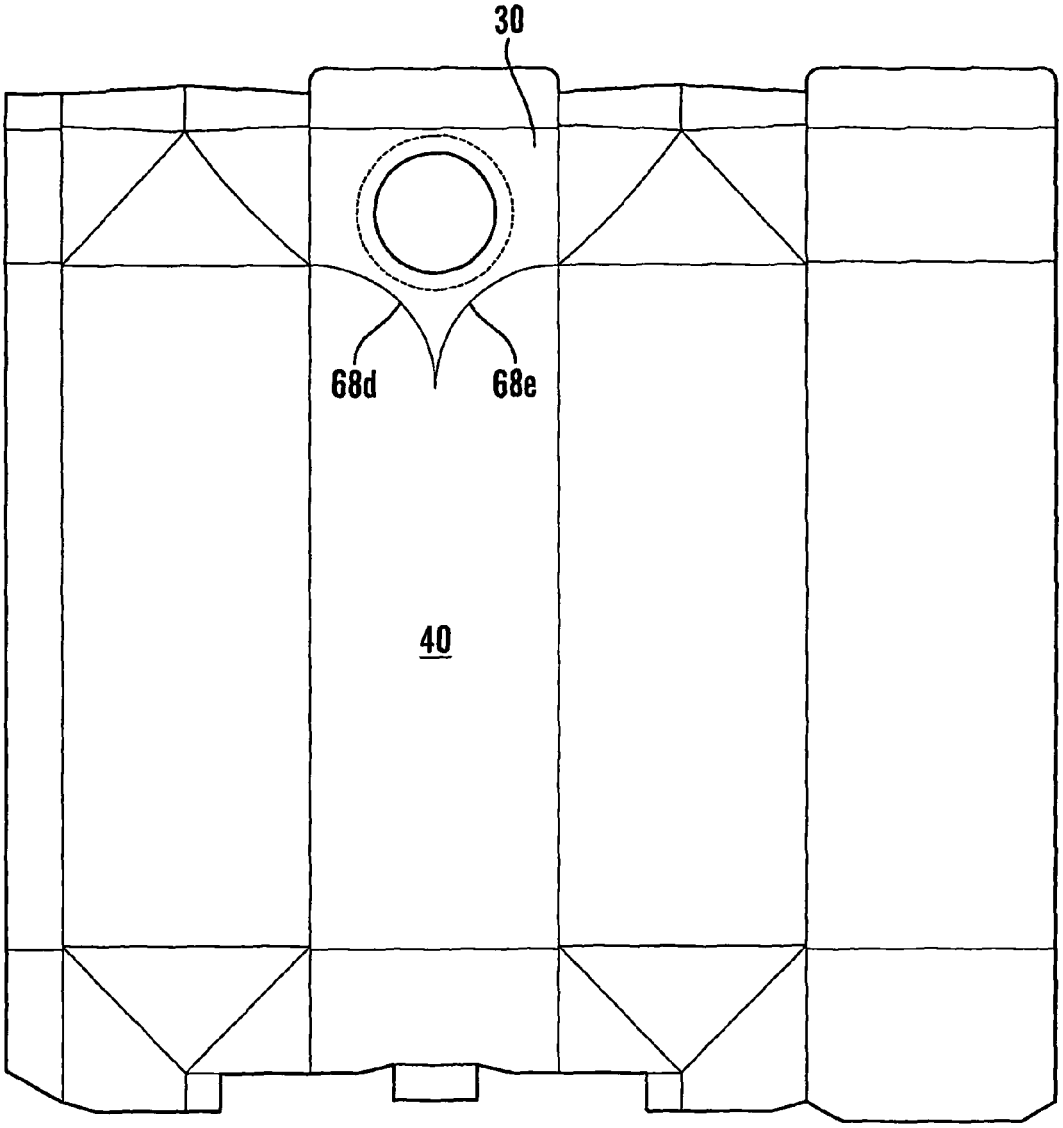

The versions of FIGS. 9 to 12 differ from those of FIGS. 1 and 2 in that, instead of the linear weakness which forms the boundary between the sub-panels 30 and 40 and protrudes into the sub-panel 40 being in the form of a single arcuate score line 68 or three straight score lines 68*a* to 68*c*, it is constituted by score lines which consist of a plurality of arcuate portions, such as the two arcuate portions 68*d* and 68*e* shown in FIG. 9, or the three arcuate portions 68*f* to 68*h* shown in FIG. 10 (which is similar to the version shown in FIG. 6, except that the arc portion 68*g* in FIG. 10 protrudes to a greater extent into the sub-panel 40), or a combination of arcuate and straight portions, as in FIG. 11 where two arcuate score lines 68*i* and 68*j* are joined together by a straight score line 68*k*, or, as shown in FIG. 12, two short straight substantially horizontal score lines 68*l* and 68*m* joined by a curved score line 68*n*, end portions 86 of which project into the sub-panel 30 at respective opposite sides of the fitment 72 and serve the same purpose as the score lines 76, 76*a*, 76*b* and 84 previously described.

The configuration of the score lines on the sub-panels 30 and 40, especially the score lines 76, 76*a*, 76*b* and 84 and the portions 86 on the sub-panel 30, depends upon the type of laminate packaging material used and upon the type of fitment 72, if used. Thus, in a carton having a readily pliable flange on the fitment 72, the flange does not firmly support the folding of the laminate material, resulting in an incorrect bending along the boundary between the sub-panels 30 and 40. FIG. 13 shows a version similar to that of FIGS. 1 and 7, except that extra arcuate score lines 88 are added which extend from respective locations where the score lines 58, 68 and 76 meet the score lines 7 and 9 to respective locations at respective opposite sides of the fitment 72. The score lines 88 divide the sub-panel 30 into two sub-sub-panels 90 and 91. The sub-sub panel 90 is located between the curved score line 68 and the score lines 88 and the lowest and foremost portion of the fitment 72; and the sub-sub-panel 91 is bounded by the score lines 88, the rearmost portion of the fitment 72 and the score line 74. The sub-sub-panel 90 helps to ensure the correct bending of the blank.

In the versions shown in FIGS. 9 to 11, there is no pre-formed linear weakness portion immediately adjacent to the lowest and foremost portion of the fitment 72, so that that portion of the laminate material which is immediately adjacent to that lowest and foremost portion and which is bent to form part of the edge between the sub-panels 30 and 40, the position of the bend being determined to a large extent by the position of that lowest and foremost portion, can bend where appropriate, without there being a pre-formed linear weakness portion at that part of the edge.

The linear weakness constituted by the score lines 68 and 68*a* to 68*n* in FIGS. 1 to 13 need not be continuous between the score lines 7 and 9. FIGS. 14 to 19 show versions in which, again, there is no pre-formed linear weakness portion immediately adjacent the lowest and foremost portion of the fitment 72, because the pre-formed linear weakness present is discontinuous and bounds a zone 92 where the blank region to form the top obturating roof sub-panel 130 and the blank region to form the front body sub-panel 140 merge into each other.

FIG. 14 shows a basic version in which a pair of curved score lines 168 extend, from respective locations where the score lines 58 meet the score lines 7 and 9, inwardly and downwardly towards a mid-zone of the potential front sub-panel 140. The versions shown in FIGS. 15 to 17 differ from that shown in FIG. 14 in that the curved score lines 168 continue downwardly along respective curved paths until they meet the score lines 7 and 9 again. The version shown in FIG. 18 differs from that of FIG. 14 in that there is a loop of weakness constituted by a score line 184 which loops around the hole 70, contacts the inner ends of the curved score lines 168 and terminates at the score lines 7 and 9. The respective portions of the score line 184 below the point at which the score lines 168 contact the score line 184 are important for the folding process when relatively large fitments 72 are to be used.

The version shown in FIG. 19 differs from that shown in FIG. 14 in that, instead of the curved score lines 168, a pair of short straight score lines 268 are employed. The score lines 268 shown are at an angle with respect to the horizontal, but could instead be substantially horizontal.

Depending upon the configuration of the score lines 168 and 268, the size of the merger zone 92 can be varied. The presence of the zone 92 provides greater possibilities in the folding of the carton top configuration and thus allows a variety of fitments to be applied, since the flange of the fitment 72 is able naturally to determine the location at which the merge zone 92 bends. Moreover, upon bending, there is a reduced risk of cracking or breaking of the laminate material.

The version shown in FIGS. 20 and 21 is similar to that shown in FIGS. 1 and 7 but differs in that, instead of the straight, substantially horizontal score line 60 constituting the boundary between the roof and body sub-panels 26 and 36, the boundary between the corresponding roof and body sub-panels 326 and 336 is defined by a curved score line 360, which protrudes into the sub-panel 336 in the same manner as the score line 368, corresponding to the score line 68, protrudes into the sub-panel 340.

When the blank 302 is folded to form a top-sealed carton 304, the sub-panel 326 forms a quadrangular top obturating rear sub-panel and the sub-panel 336 forms the rear body sub-panel.

Upon arranging a plurality of cartons 304 in a row for storage and/or transportation, where the cartons 304 are placed in a manner where the front body sub-panel of one carton is placed against the rear body sub-panel of the carton in front of it, the lowest and foremost portion of the fitment 72 will be located above the central portion of the score line 360. Therefore, that lowest and foremost portion of the fitment 72 will not abut the edge formed by the score line 360, as would be the case if that score line were to be straight and horizontal.

The version shown in FIG. 22 differs from that shown in FIG. 20 in that, instead of the boundary between the sub-panels 326 and 336 being constituted by the curved score line 360, the linear weakness between a potential top obturating rear sub-panel 426 and a potential rear body sub-panel 436 is discontinuous and constituted by a pair of short straight score lines 460, which extend inwardly and downwardly, with a zone 492 where the potential sub-panels 426 and 436 merge.

The configuration of the score lines 360 and 460 may vary and does not have to mirror that of the score lines 368 and 468. In addition, further score lines, similar to the score lines 76 in FIG. 1, can be added to the potential top obturating rear sub-panels 326 and 426 to help ensure correct bending of the blank during the folding process.

In all of the carton blanks shown, at least one boundary between a potential top obturating roof sub-panel 30, 130, 326 and 330 and a potential side sub-panel 40, 140, 336 and 340 has a linear weakness which is discontinuous and/or comprises linear weakness portions which extend transversely of the row of the four main panels of the carton blank.

In cases where the linear weakness has portions 68*d* and 68*e* shown in FIG. 9, 68*f* and 68*h* in FIG. 10, 68*i* and 68*j* in FIG. 11, 168 in FIGS. 14 to 18, and 268 in FIG. 19, the distance between each of these portions and a central region of the adjacent top obturating roof sub-panel initially decreases, progressing inwardly from their respective (upper) junctions with the score lines 7 and 9, and then increases.

All of the versions shown are suitable for non-aseptic or aseptic packaging of flowable substances on form-fill-seal packaging machines, in particular for gable-top cartons, and especially for packaging from a laminate material incorporating aluminium foil.

The invention claimed is:

1. A carton blank for a rectangular gable-top carton and comprising a row of panels arranged side-by-side, the boundaries among said panels being defined by a set of lines of weakness parallel to each other, one of said panels including not only a first region for forming a first top obturating sub-panel comprising a first group of a plurality of substantially triangular sub-sub-panels defined by lines of weakness, but also, disposed outwardly thereof, a first top sealing sub-panel, another of said panels immediately adjacent said one of said panels including not only a second region for forming a quadrangular top obturating sub-panel having an opening zone, but also disposed immediately outwardly thereof and separated by a first linear weakness, a second top sealing sub-panel, and, immediately inwardly thereof, a body sub-panel, said second region including a boundary zone furthest from said first linear weakness, said boundary zone having a second linear weakness which is discontinuous and/or comprises linear weakness portions which extend transversely of said row of panels, and said opening zone includes respective opposite peripheral portions which extend to the region of the first and second linear weaknesses.

2. A blank according to claim 1, wherein said second linear weakness comprises linear weakness portions arranged such that, progressing inwardly from respective opposite upper edge zones of said body sub-panel, the distance between each of said linear weakness portions and a central zone of said second region initially decreases and then increases.

3. A blank according to claim 2, wherein said linear weakness portions are arcuate and bow towards a central zone of said second region.

4. A blank according to claim 3, wherein said linear weakness portions comprise a third arcuate linear weakness portion between said linear weakness portions and bowed away from said central zone.

5. A blank according to claim 3, wherein said linear weakness portions are extended downwards and outwards towards those respective lines of weakness of said set of lines of weakness bounding said body sub-panel.

6. A blank according to claim 1, wherein said second region is formed with further lines of weakness extending inwardly from respective opposite upper edge zones of said body sub-panel towards the central zone of said second region, so as to bound, with said second linear weakness, a sub-region to form a sub-sub-panel of said quadrangular top obturating sub-panel in which said opening zone is located.

7. A blank according to claim 1, wherein a further one of said panels includes not only a third region for forming a second quadrangular top obturating sub-panel, but also disposed outwardly thereof, a third top sealing sub-panel, and, inwardly thereof, a second body sub-panel, there being, between said second quadrangular top obturating sub-panel and said second body sub-panel, as a boundary therebetween a third linear weakness which protrudes into said second body sub-panel.

8. A blank according to claim 1, wherein said panels include a further panel including not only a region for forming a further top obturating sub-panel comprising a second group of a plurality of substantially triangular sub-sub-panels defined by lines of weakness, but also, disposed outwardly thereof, a further top sealing sub-panel, one of the lines of weakness defining said plurality of substantially triangular sub-sub-panels of said first group and one of the lines of weakness defining said plurality of substantially triangular sub-sub-panels of said second group which extend obliquely relative to said row and are nearer said second group being curved and bowing away from said second region.

9. A blank according to claim 1 and further comprising at respective opposite sides of the central zone of said second region respective lines of weakness which divide said second region into first, second and third substantially triangular sub-sub-panels of which the first and third sub-sub-panels are at respective opposite sides of the second sub-sub-panel.

10. A blank according to claim 1 and further comprising an inverted U-shaped loop of weakness extending around the opening zone of said second region.

11. A carton blank of laminate packaging material and including a row of panels arranged side-by-side, the boundaries among said panels being defined by a set of lines of weakness parallel to each other, one of said panels having a region for forming a quadrangular top obturating sub-panel, another region for forming a body sub-panel, and linear weakness portions between those regions and extending inwardly from respective opposite upper edge zones of said other region, such that, progressing inwardly from said respective opposite upper edge zones, the distance between each of said linear weakness portions and a central zone of the first-mentioned region initially decreases and then increases.

12. A blank according to claim 11, wherein said linear weakness portions are arcuate and bow towards the central zone of the first-mentioned region.

13. A blank according to claim 12, wherein said linear weakness comprises a third arcuate linear weakness portions between said linear weakness portions and bowed away from said central zone.

14. A blank according to claim 12, wherein said linear weakness portions are extended downwards and outwards towards those respective lines of weakness of said set of lines of weakness bounding said body sub-panel.

15. A blank according to claim 11, wherein the quadrangular top obturating sub-panel is formed with further lines of weakness extending inwardly from the respective opposite upper edge zones of said body sub-panel towards the central zone of the quadrangular top obturating sub-panel, so as to bound, with said linear weakness portions, a sub-sub-panel of said top sub-panel.

16. A blank according to claim 11, wherein a further one of said panels includes a region for forming a further quadrangular top obturating sub-panel and a further region for forming a further body sub-panel, there being, between the further quadrangular top sub-panel and the further body sub-panel, as a boundary therebetween a second linear weakness portion which protrudes into the further body sub-panel.

17. A blank according to claim 11, wherein there are, at respective opposite sides of the quadrangular top obturating sub-panel respective further top obturating sub-panels comprising respective groups of substantially triangular sub-sub-panels having respective curved, oblique linear weaknesses bowed away from the first mentioned quadrangular top obturating sub-panel.

18. A blank according to claim 11, and further comprising at respective opposite sides of the central zone of the quadrangular top obturating sub-panel, respective lines of weakness which divide the quadrangular top obturating sub-panel into first, second and third substantially triangular sub-sub-panels of which the first and third sub-sub-panels are at respective opposite sides of the second sub-sub-panel.

19. A blank according to claim 11, and further comprising an inverted U-shaped loop of weakness extending around the central zone of the quadrangular top obturating sub-panel.

20. A carton blank of laminate packaging material and including a row of panels arranged side-by-side, the boundaries among said panels being defined by a set of lines of weakness parallel to each other, one of said panels having a region for forming a quadrangular top obturating sub-panel, another region for forming a body sub-panel, and a discontinuous linear weakness therebetween.

21. A blank according to claim 20, wherein the quadrangular top obturating sub-panel is formed with further lines of weakness extending inwardly from the respective opposite upper edge zones of said body sub-panel towards the central zone of the quadrangular top obturating sub-panel, so as to bound, with said linear weakness portions, a sub-sub-panel of said quadrangular top obturating sub-panel.

22. A blank according to claim 20, wherein a further one of said panels includes a region for forming a further quadrangular top obturating sub-panel and a further region for forming a further body sub-panel, there being, between the further quadrangular top obturating sub-panel and the further body sub-panel, as a boundary therebetween a second linear weakness portion which protrudes into the further body sub-panel.

23. A blank according to claim 20, wherein there are, at respective opposite sides of the quadrangular top obturating sub-panel respective further top obturating sub-panels comprising respective groups of substantially triangular sub-sub-panels having respective curved, oblique linear weaknesses bowed away from the first mentioned quadrangular top obturating sub-panel.

24. A blank according to claim 20 and further comprising at respective opposite sides of the central zone of the quadrangular top obturating sub-panel, respective lines of weakness which divide the quadrangular top obturating sub-panel into first, second and third substantially triangular sub-sub-panels of which the first and third sub-sub-panels are at respective opposite sides of the second sub-sub-panel.

25. A blank according to claim 20 and further comprising an inverted U-shaped loop of weakness extending around a central zone of the top sub-panel.

26. A package comprising a top-sealed gable-top carton rectangular in cross-section, a flowable substance contained in said carton, and a pour spout fitment openable to pour said substance from said carton, said carton including a top closure including a roof sub-panel carrying and sealed to a flange of said fitment, said carton also including a front sub-panel extending downwardly from a boundary zone between said roof sub-panel and said front sub-panel, said boundary zone being constituted by an edge protruding into said front sub-panel, and said flange having respective opposite peripheral portions which extend adjacent to said edge and adjacent to a further boundary zone opposite the first-mentioned boundary zone and between said roof sub-panel and a top sealing sub-panel disposed immediately outwardly of said roof sub-panel.

27. A package according to claim 26, wherein said carton is of laminate packaging material, the first-mentioned boundary zone comprising linear weakness portions which extend inwardly from respective opposite upper edge zones of said front sub-panel, such that, progressing inwardly from said respective opposite upper end zones, the distance between each of said linear weakness portions and a central zone of said roof sub-panel initially decreases and then increases.

28. A package according to claim 27, wherein said linear weakness portions are arcuate and bow towards the central zone of said roof sub-panel.

29. A package according to claim 28, wherein said linear weakness portions comprises a third arcuate linear weakness portion between said linear weakness portions and bowed away from said central zone.

30. A package according to claim 28, wherein said linear weakness portions are extended downwards and outwards towards those respective lines of weakness of said set of lines of weakness bounding said front sub-panel.

31. A package according to claim 26, wherein said roof sub-panel is formed with lines of weakness extending inwardly from respective opposite upper edge zones of said front sub-panel towards a central zone of said roof sub-panel, so as to bound, with said boundary zone, a sub-sub-panel of said roof sub-panel and having said pour spout fitment sealed thereto.

32. A package according to claim 26, and further including a rear roof sub-panel and, disposed outwardly thereof, a rear top sealing sub-panel, and, inwardly thereof, a rear body sub-panel, there being, between said rear roof sub-panel and said rear body sub-panel, as a third boundary zone therebetween a linear weakness which protrudes into said rear body sub-panel.

33. A package according to claim 26, wherein there are, folded behind the front roof sub-panel and at respective opposite sides thereof respective substantially triangular sub-sub-panels having respective curved, oblique edges bowed towards the central zone of said roof sub-panel.

34. A package according to claim 26 and further comprising at respective opposite sides of the central zone of said roof sub-panel, respective lines of weakness which divide said roof sub-panel into first, second and third substantially triangular sub-sub-panels of which the first and third sub-sub-panels are at respective opposite sides of the second sub-sub-panel on which said pour spout fitment is located.

35. A package according to claim 26 and further comprising an inverted U-shaped loop of weakness extending around said fitment of the front roof sub-panel.

36. A package comprising a top-sealed carton of laminate packaging material, and a flowable substance contained in said carton, said carton including a top closure including a quadrangular roof sub-panel, and a body sub-panel extending downwardly from a boundary between said roof sub-panel and said body sub-panel, said boundary comprising linear weakness portions which extend inwardly from respective opposite upper edge zones of said body sub-panel, such that, progressing inwardly from said respective opposite upper end zones, the distance between each of said linear weakness portions and a central zone of said roof sub-panel initially decreases and then increases.

37. A package according to claim 36, wherein said linear weakness portions are arcuate and bow towards the central zone of said roof sub-panel.

38. A package according to claim 37, wherein said linear weakness portions comprises a third arcuate linear weakness portion between said linear weakness portions and bowed away from said central zone.

39. A package according to claim 37, wherein said linear weakness portions are extended downwards and outwards towards those respective lines of weakness of said set of lines of weakness bounding said body sub-panel.

40. A package comprising a top-sealed carton of laminate packaging material, and a flowable substance contained in said carton, said carton including a top closure including a quadrangular roof sub-panel, and a body sub-panel extending downwardly from a boundary between said roof sub-panel and said body sub-panel, said boundary including a discontinuous linear weakness.

41. A package comprising a top-sealed carton of laminate packaging material, a flowable substance contained in said carton, and a pour spout fitment openable to pour said substance from said carton, said carton including a top closure including a quadrangular roof sub-panel carrying and sealed to a flange of said fitment, said carton also including a front sub-panel extending downwardly from a boundary between said roof sub-panel and said front sub-panel, said boundary being constituted by an edge having no pre-formed linear weakness portion immediately adjacent to a lowest and foremost portion of said flange.

* * * * *